US007484685B2

(12) United States Patent
Kückelmann et al.

(10) Patent No.: US 7,484,685 B2
(45) Date of Patent: Feb. 3, 2009

(54) METHOD FOR KNOCKING OFF A WEB WOUND ON A TURRET WINDER

(75) Inventors: Andreas Kückelmann, Ibbenbüren (DE); Wolfgang Brusdeilins, Bielefeld (DE); Gordon Whitelaw, Bielefeld (DE)

(73) Assignee: Fischer & Krecke GmbH & Co. KG, Bielefeld (DE)

( * ) Notice: Subject to any disclaimer, the term of this patent is extended or adjusted under 35 U.S.C. 154(b) by 119 days.

(21) Appl. No.: 11/613,147

(22) Filed: Dec. 19, 2006

(65) Prior Publication Data

US 2007/0145177 A1 Jun. 28, 2007

(30) Foreign Application Priority Data

Dec. 24, 2005 (EP) ..... 05028450

(51) Int. Cl.
*B65H 35/04* (2006.01)

(52) U.S. Cl. ..... 242/527.2; 242/533.4

(58) Field of Classification Search ..... 242/527, 242/527.2, 533.4, 533.5
See application file for complete search history.

(56) References Cited

U.S. PATENT DOCUMENTS

| | | | | |
|---|---|---|---|---|
| 2,973,158 | A | 2/1961 | Zernov | |
| 5,086,986 | A * | 2/1992 | Twente | 242/527.2 |
| 5,417,382 | A * | 5/1995 | Petitjean et al. | 242/527 |
| 6,082,659 | A | 7/2000 | Sankaran et al. | |
| 2004/0155138 | A1 * | 8/2004 | Kolbe et al. | 242/527.2 |

FOREIGN PATENT DOCUMENTS

| | | |
|---|---|---|
| EP | 1295831 A1 | 3/2003 |
| EP | 1454858 A1 | 9/2004 |

* cited by examiner

*Primary Examiner*—Sang Kim
(74) *Attorney, Agent, or Firm*—Richard M. Goldberg

(57) ABSTRACT

A method for knocking-off a web (12) round on a turret winder (10) by a knocking-off device (22) includes a pressure roller (24), in which the knocking-off device (22) and a coil (16) of the winder (10) are, through an abrupt relative movement, brought into a position in which the pressure roller (24) engages the periphery of the coil (16) and the abrupt movement is a pivotal movement (B) of the coil (16) about a pivotal axis that extends in parallel with the axes of rotation thereof.

13 Claims, 2 Drawing Sheets

METHOD FOR KNOCKING OFF A WEB WOUND ON A TURRET WINDER

BACKGROUND OF THE INVENTION

The present invention relates to a method for knocking off a web wound on a turret winder according to the preamble of claim 1 and to a turret winder according to the preamble of claim 6.

Such turret winders are employed for example in rotary printing machines as coil-forming winders for a printed web, as is shown for example in EP 1 454 858 A1. The web is wound onto a core against which a pressure roller of a knock-off device has been set in order to assure a uniform and blister-free winding of the winding layers. While the pressure roller rotates freely, the coil that is held by a chuck is driven for rotation by a rotary drive system. By means of an adjustable support of the knock-off device, e. g, a carriage driven by a pneumatic cylinder, the position of the pressure roller may be adjusted in accordance with the radius of the coil.

The coils of the turret winder are either disposed at the ends of roller arms that project from a central pivoting axle, or the winder is a so-called rotary star winder wherein the coils are arranged at the periphery of a rotary star and are pivotable by means of a central rotary drive system for the rotary star. A change of the coil that engages the pressure roller of the knock-off device can be accomplished by rotating the rotary star. When, for example, a completed coil in the winding position at the pressure roller shall be replaced by an empty coil or core, the completed coil pivots into a withdrawal position during continued transport of the web, while the empty core simultaneously reaches the winding position. In this position, the knock-off operation may be performed, wherein the running web is pressed against an adhesive portion of the new core and, at the same time, the web is cut, so that the web may directly run onto the new coil via the pressure roller, while the completed coil with the cut-off web can be withdrawn. In conventional turret winders, the knock-off operation is performed by advancing the knock-off device together with the pressure roller, so that the latter presses the web against the adhesive portion on the core which will then take over the web, while a knock-off blade abruptly cuts through the web in a suitable position downstream of the adhesive portion. This knock-off operation must be performed very quickly, in accordance with the speed of the running web. However, when the pressure roller is advanced with high speed, which results in a hard impact on the winding core, problems may be caused which are due to a swing-back of the pressure roller, vibrations and the like. It may therefore happen that the process of knocking off the web and transferring the same onto the new coil fails.

SUMMARY OF THE INVENTION

It is therefore an object of the present invention to improve the method for knocking off a web wound on a turret winder in such a manner that the knock-off operation can be performed more reliably. It is another object of the invention to provide a turret winder which assures a more reliable knock-off operation and hence a smooth exchange of the coils.

According to the invention, this object is achieved by a method according to claim 1 and by a turret winder according to claim 6.

In the method according to the invention, the abrupt movement of the pressure roller relative to the coil into the position in which the pressure roller engages the peripheral surface of the coil is achieved by a pivotal movement of the coil about its pivotal axis. In this case, the impact of the pressure roller against the coil is smoother than in the prior art, because, due to the pivotal movement, the winding core may move approximately tangentially to the peripheral surface of the pressure roller. The forces involved in the knock-off operation are reduced, and the risk of a swing-back of the impacting components is reduced. The adhesive portion of the core can be hit and held more reliably, and the knock-off operation is performed more reliably than with the conventional method.

In a preferred embodiment, the pressure roller, before it comes into contact with the coil, is advanced in an essentially radial direction relative to the pivotal movement of the coil into a position in which the pressure roller can be caught by the coil during the pivotal movement of the latter. This advance movement may be performed when, by rotation of the rotary star, a completed coil has been pivoted into a withdrawal position and a new winding core has simultaneously been pivoted into a stand-by position close to the knock-off device, from which position the abrupt pivotal movement for the knock-off operation may start.

During the phase of the pivotal movement in which the pressure roller and the coil contact each other, the pressure roller preferably retreats in a direction opposite to the direction of advance under the pressure exerted by the coil during the pivotal movement. By means of a support structure that admits such a retreat of the pressure roller, the impact forces are reduced further, and the knock-off operation may be performed even more reliably.

In another preferred embodiment of the method, a knock-off blade that is provided on the knock-off device is jolted forwardly in the direction of the web simultaneously with the abrupt pivotal movement of the coil and cuts through the web.

Preferably, the pressure roller deflects the web between a section that extends approximately radially of the pivoting direction of the coil and a section that extents essentially tangentially of the pivoting direction, and the coil, during its pivotal movement, approaches the pressure roller from the side facing away from said tangential section. Thanks to this arrangement, the coil may approach the pressure roller from the free side thereof in the direction of the tangentially deflected web section. Especially when the turret winder is a coil-forming winder, the abrupt pivotal movement may occur in the direction of the running web, because the web supplied from the rotary printing machine will in this case run into the tangential section via the pressure roller. Since the speed difference between the transport of the web and the pivotal movement of the coil is reduced, this contributes to a further reduction of the impact forces.

Claim 6 relates to a turret winder the coils of which can be pivoted about a central pivoting axis by means of a pivotal drive mechanism, and a knock-off device for the web, which device comprises a pressure roller, wherein the knock-off device and a coil can be moved, by an abrupt relative movement, into a position in which the pressure roller engages the peripheral surface of the coil, and wherein the pivotal drive mechanism is provided for creating the abrupt movement in the form of a pivotal movement of the coil.

Preferred embodiments of this turret winder are indicated in the dependent claims 7-13.

BRIEF DESCRIPTION OF THE DRAWINGS

A preferred embodiment of the invention will now be explained in conjunction with the drawings.

DETAILED DESCRIPTION

Figure 1:
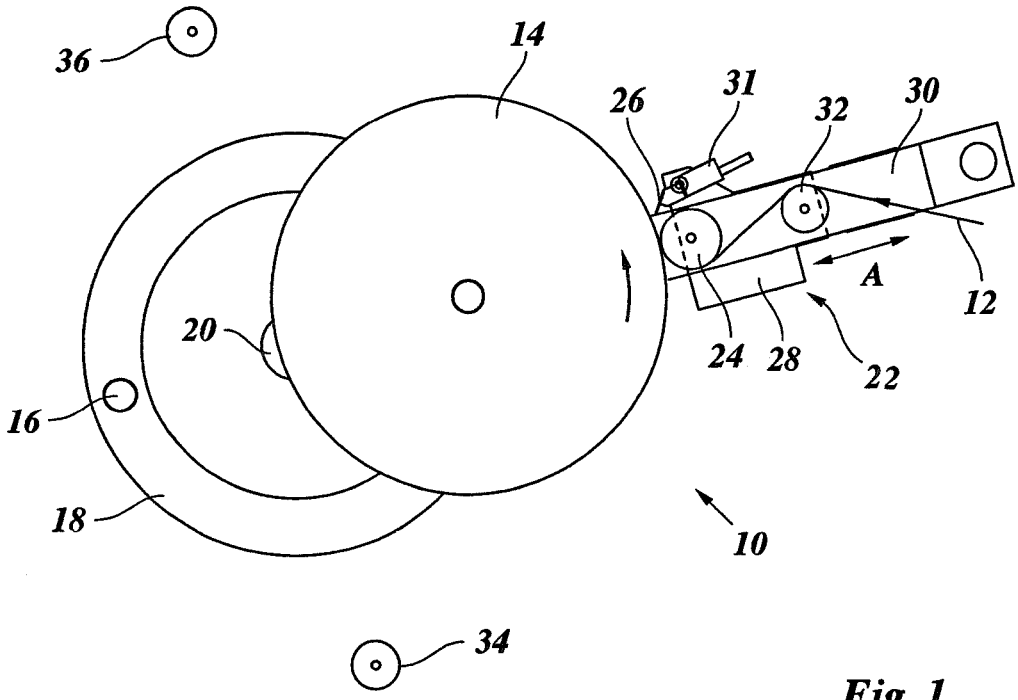
FIG. 1 diametrically shows an embodiment of a turret winder according to the invention in a first phase of the winding process.

The turret winder shown in FIG. 1 is a rotary star-type winder 10 for winding a web 12 which is supplied from the right side in the drawing from a non-illustrated rotary printing machine onto a coil 14 of the winder 10. In the shown phase, the coil 14 has already been completed and will be replaced by an empty coil or core 16, as illustrated in the subsequent figures. It is observed that, in the description to follow, the term "coil" is used for both, completed coils and empty coils, including also empty winding cores in the form of cardboard sleeves that are provided with an adhesive strip for fixing one end of the web thereto. The empty coil 16 is such a sleeve.

The two coils 14 and 16 are arranged in diametrically opposite peripheral positions of a rotary star 18 which is essentially formed by a circular disk that can be driven to rotate by means of a pivotal drive mechanism 20 disposed in the centre of the disk, so as to pivot the coils 14 and 16 about an axis that passes through the centre of the rotary star 18 and extends in parallel with the axis of rotation of the coils 14, 16. By means of a pivotal movement of 180° , corresponding to a half turn of the rotary star 18, the coils 14 and 16 exchange their positions.

On the right side in FIG. 1, there is disposed a knock-off device 22 comprising a pressure roller 24 and a knock-off blade 26 that are arranged on a carriage 28 to be slideable along a rail 30. The rail 30 is fixed in a machine frame the details of which have not been shown in the drawings for reasons of clarity. By means of a suitable linear drive mechanism, e.g., a pneumatic cylinder, the carriage 28 may be moved back and forth along the rail 30 in directions that are oriented radially relative to the direction of rotation of the rotary star 18 and hence the pivoting direction of the coils 14, 16, as indicated by a double-headed arrow A, because the rail 30 aims at the centre of the rotary star, where the rotary drive mechanism is coupled thereto. The knock-off blade 26 can be moved towards the web 12 by means of a linear drive 31 mounted to the carriage 28.

The pressure roller 24 is arranged to engage the peripheral surface of the coil 14 facing the same, while this coil rotates, so as to achieve a smooth winding of the layers of the web without forming blisters. The web 12 runs over a deflection roller 32 that is rotatably supported on the carriage 28, and then to the pressure roller 24 and is deflected thereby onto the coil 14 which rotates counter-clockwise in FIG. 1. The drive mechanism for the carriage 28 permits to move the same along the rail 30 in such a manner that the idling pressure roller 24 will always engage the coil 14 and provide a suitable contact pressure.

Figure 2:
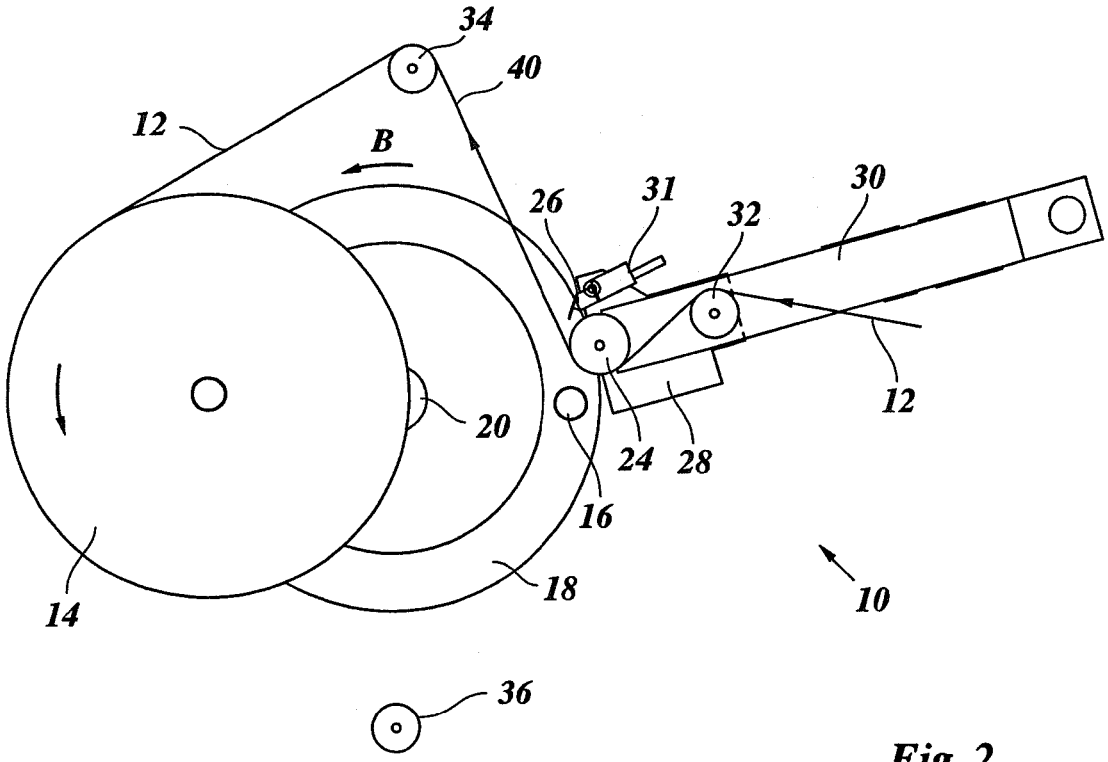
FIG. 2 diametrically shows an embodiment of a turret winder according to the invention in a second phase of the winding process.

For removing the completed coil 14, the latter is at first pivoted, by rotation of the rotary star 18, over an angle that is slightly smaller than 180°, as has been shown in FIG. 2. During this, two deflection rollers 34, 36 that are disposed above and below the rotary star 18 mirror-symmetrically relative to an imaginary line connecting the two coils 14, 16, are pivoted together with the coils 14, 16, so that the lower deflection roller 34 in FIG. 1 moves from below into the section of the web 12 leaving the pressure roller 24 and then assumes the position shown in FIG. 2. The empty coil 16 is now in a position approximately below the pressure roller 24. The pressure roller 24 has itself been driven by the carriage 28 into a position advanced towards the rotary star 18, in which position the empty coil 16 which is to take-up the web 12 can engage, with its peripheral surface, the surface of the pressure roller 24, when the coil is pivoted counter-clockwise (arrow B) beyond the position shown in FIG. 2. When the stand-by position for knock-off, as shown in FIG. 2, has been reached, the knock-off operation, i. e. the transfer of the web 12 onto the empty coil 16 with simultaneous cutting of the web section running onto the completed coil 14, may be performed, as will be described below.

Starting from the position shown in FIG. 2, the rotary star 18 is driven by the drive mechanism 20 to perform and abrupt counter-clockwise rotary movement, so that the empty coil 16 makes an abrupt pivotal movement (arrow B) towards the pressure roller 24, until the periphery of the coil 16 engages the pressure roller. At the same time, the linear drive 31 for the knock-off blade 26 is actuated, so that the blade jolts forward towards the section 40 of the web 12 that leaves the pressure roller 24 in a direction approximately tangential to the direction of rotation of the rotary star 18, and cuts through the web. In this knock-off operation, it must be assured that the web 12 is cut in such a manner that the end of the web 12 upstream of the knock-off blade 26, which end passes over the pressure roller 24, is caught by the core of the empty coil 16, i. e. is fixed to the adhesive strip and is neatly wound up by rotation of the coil 16. The now free end 42 of the cut web can then be wound onto the completed coil 14 on the opposite side.

The method for knocking off the web 12, as described herein, has the advantage that the abrupt pivotal movement of the new coil 16 does not take place radially of the pressure roller 24, but rather approximately tangentially to the peripheral surface thereof. This avoids a hard impact that could lead to vibrations or to a swing-back of the pressure roller 24 and hence to a failure of the knock-off operation.

Figure 3:
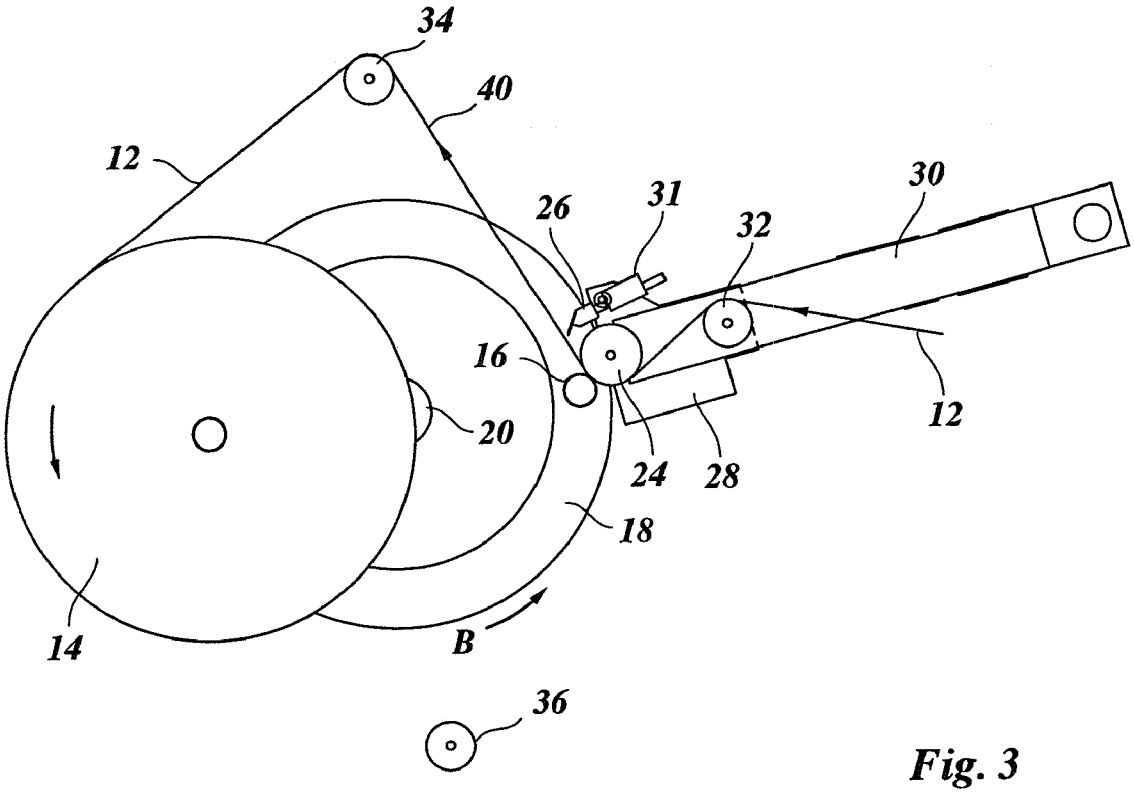
FIG. 3 diametrically shows an embodiment of a turret winder according to the invention in a third phase of the winding process.
Figure 4:
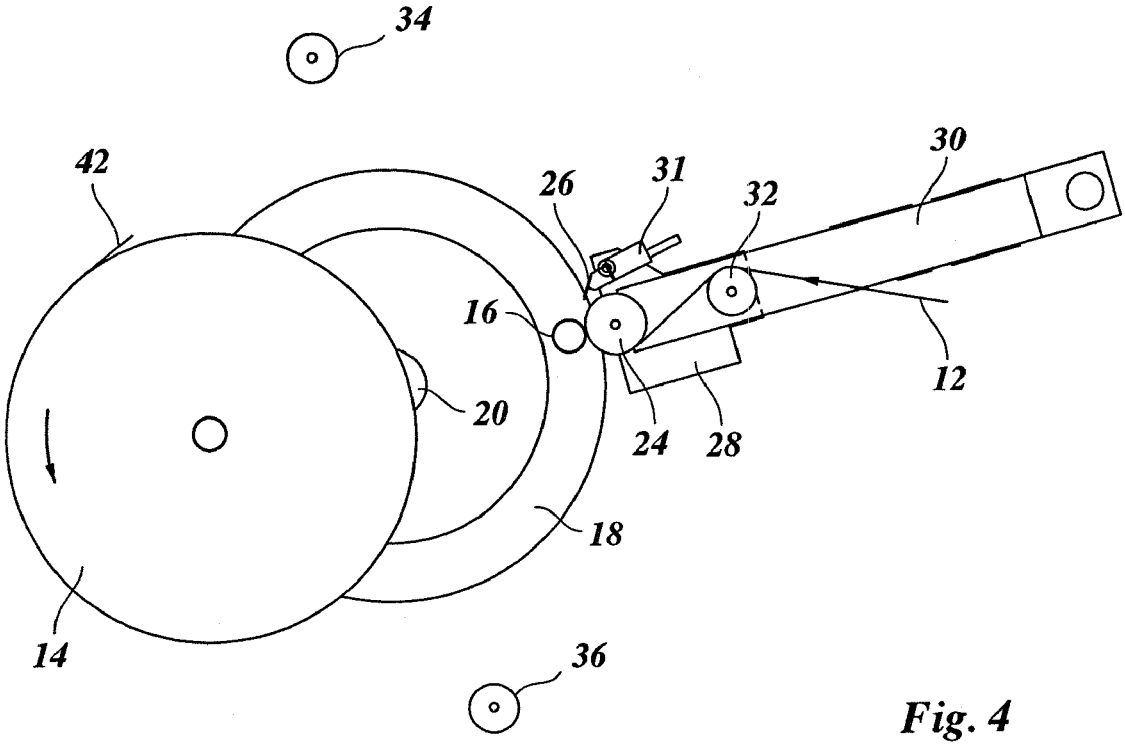
FIG. 4 diametrically shows an embodiment of a turret winder according to the invention in the final phase of the winding process.

In the position shown in FIG. 3, in which the pressure roller 24 comes into contact with the coil 16, the pivotal movement of the coil 16 caused by rotation of the rotary star 18 is not yet completed in the present embodiment. The carriage 28 is supported such that it may retreat from the rotary star 18 under the pressure exerted by the peripheral surface of the coil 16. Thus, the pressure roller 24 can yield to the pressure of the coil 16, until the position shown in FIG. 4 is reached, in which the web is wound up by the coil 16. In FIG. 4, the rotary star 18 has made a half turn in comparison to FIG. 1, so that the empty core 16 in FIG. 4 has assumed the winding position of the completed coil 14 in FIG. 1, whereas the completed coil 14 on the rotary star 18 now assumes a diametrically opposite withdrawal position. In this position, the winding operation is continued (with the coil 16) as in FIG. 1, so that a new winding cycle may start. In accordance with the increasing radius of the coil 16, the carriage 28 is gradually withdrawn from the rotary star 18, while the pressure roller 24 is always held in engagement with the periphery of the coil 16.

The invention is not only applicable to a turret winder serving as a coil-forming winder, but may equivalently be applied to a reel-off winder. In this case, in the position shown in FIG. 1, which is now a reeling-off position, the web 12 runs from a full coil 14 towards the right to a non-illustrated rotary printing press, that the coil 14 is gradually emptied. In analogy to the process that has been described above in conjunction with FIGS. 2 and 3, shortly before the knock-off operation, the almost empty coil is at first moved into the stand-by position shown in FIG. 2 and then by the abrupt knock-off movement into the positions shown in FIGS. 3 and 4. The new coil that is to be applied against the pressure roller 24 for supplying a new web 12 is in this case a full coil, which, according to the invention, is engaged against the pressure roller 24 by an abrupt pivotal movement of the rotary star 18, as induced by the drive mechanism 20. Due to the larger diameter of the full coil, the carriage 28 will in this case be held in a stand-by position prior to the knock-off operation, which is removed further from the rotary star 18 and in which the pressure roller 24 can be engaged by the periphery of the new full coil.

The invention claimed is:

1. A method for knocking-off a web wound on a turret winder by a knock-off device including a pressure roller, comprising the step of bringing the knock-off device and a coil of the winder, through an abrupt relative movement, into a position in which the pressure roller engages a periphery of the coil, and wherein the abrupt movement is a pivotal movement of the coil about a pivotal axis that extends in parallel with an axis of rotation of the coil.

2. The method of claim 1, further comprising the step of advancing the pressure roller, before it contacts the coil, in a direction oriented essentially radially of the pivotal movement of the coil into a position in which the pressure roller can be engaged by the pivoting coil.

3. The method of claim 2, further comprising the step of, during a phase of the pivotal movement in which peripheral surfaces of the pressure roller and the coil engage one another, providing that the pressure roller retreats under pressure exerted by the coil into a direction opposite to the direction of advance.

4. The method according to claim 1, further comprising the step of, simultaneously with the pivotal movement of the coil, jolting a knock-off blade of the knock-off device towards the web to cut through the web at the same time.

5. The method according to claim 1, further comprising the step of:

deflecting the web between a section extending essentially radially of the pivotal direction of the coil and a section extending essentially tangentially of the pivotal direction, by the pressure roller, and providing that the coil is approached towards the pressure roller during the pivotal movement from a side that faces away from said tangential section.

6. A turret winder of the type having coils that are pivotable about a central pivotal axis by a pivotal drive mechanism, the winder comprising a knock-off device for a wound web, said knock-off device including a pressure roller arranged such that the knock-off device and a respective coil are arranged to be movable, in an abrupt movement, into a position in which the pressure roller engages a peripheral surface of the coil, and the pivotal drive mechanism is arranged to perform said abrupt movement in the form of a pivotal movement of the coil.

7. The winder of claim 6, wherein the pressure roller is supported to be linearly displaceable.

8. The winder according to claim 7, wherein the pressure roller is displaceable in a direction essentially radially of the pivotal movement of the coil.

9. The winder of claim 7, wherein the pressure roller is arranged to be movable between an advanced position, in which it can be engaged by the coil during the pivotal movement of the latter, and a retreated position outside of a pivotal radius of the coil.

10. The winder of claim 9, wherein the knock-off device includes a support structure for displaceably supporting the pressure roller and which is arranged to permit a yielding movement of the pressure roller towards a retreated position under the pressure exerted by the coil.

11. The winder of claim 6, wherein the knock-off device comprises a knock-off blade that is moveable by a linear drive for cutting through the web.

12. The winder of claim 11, wherein the linear drive for the knock-off blade is arranged to jolt the knock-off blade forward towards the web for cutting through the web at the same time during the pivotal movement of the coil.

13. The winder of claim 6, wherein the pressure roller is arranged to deflect the web between a section extending essentially radially of the pivotal direction of the coil and a section extending essentially tangentially of the pivotal direction, and the coil approaches the pressure roller during the pivotal movement from a side facing away from said tangential section.

* * * * *